US006554167B1

(12) United States Patent
Barrett

(10) Patent No.: US 6,554,167 B1
(45) Date of Patent: Apr. 29, 2003

(54) IMPACT PAD

(75) Inventor: Ronald Barrett, Curwensville, PA (US)

(73) Assignee: North American Refractories Co., Moon Township, PA (US)

( * ) Notice: Subject to any disclaimer, the term of this patent is extended or adjusted under 35 U.S.C. 154(b) by 0 days.

(21) Appl. No.: 09/896,672

(22) Filed: Jun. 29, 2001

(51) Int. Cl.[7] ..... B22D 41/08
(52) U.S. Cl. ..... 222/594
(58) Field of Search ..... 266/45, 275, 236; 222/590, 591, 594

(56) References Cited

U.S. PATENT DOCUMENTS

| | | | | |
|---|---|---|---|---|
| 4,043,543 | A | 8/1977 | Courtennay et al. | 266/275 |
| 4,715,586 | A | 12/1987 | Schmidt et al. | 266/275 |
| 4,993,692 | A | 2/1991 | Brown et al. | 266/229 |
| 5,072,916 | A | 12/1991 | Soofi | 266/275 |
| 5,131,635 | A | 7/1992 | Soofi | 266/275 |
| 5,133,535 | A | 7/1992 | Soofi | 266/275 |
| 5,160,480 | A | 11/1992 | Vassilicos | 266/275 |
| 5,169,591 | A | 12/1992 | Schmidt et al. | 266/275 |
| 5,188,796 | A | 2/1993 | Soofi | 266/275 |
| 5,246,209 | A | 9/1993 | Heaslip et al. | 266/229 |
| 5,358,551 | A | 10/1994 | Saylor | 75/584 |
| 5,518,153 | A | 5/1996 | Zacharias et al. | 222/594 |
| 5,551,672 | A | 9/1996 | Schmidt | 266/229 |
| 5,662,823 | A | 9/1997 | Claar et al. | 222/594 |
| RE35,685 | E | 12/1997 | Schmidt et al. | 266/275 |
| 5,861,121 | A | 1/1999 | Heaslip et al. | 266/45 |
| 6,024,260 | A | 2/2000 | Zacharias et al. | 222/594 |
| 6,102,260 | A | 8/2000 | Heaslip et al. | 222/594 |
| 6,156,260 | A | 12/2000 | Heaslip et al. | 266/45 |
| 6,159,418 | A | 12/2000 | Zacharias | 266/275 |

OTHER PUBLICATIONS

Metal Producing, pp21–23 and 47, "Taming the Thunder" Isenberg–O'Loughlin, Sep.–1994.*

* cited by examiner

*Primary Examiner*—Scott Kastler
(74) *Attorney, Agent, or Firm*—Mark Kusner; Michael A. Jaffe

(57) ABSTRACT

An impact pad for receiving a stream of liquid metal having a bottom wall with an upper surface against which said liquid metal is intended to impact, a side wall extending in an upward direction along the periphery of the bottom wall, and an annular wall extending inwardly from the side wall. The annular wall, together with the bottom wall and side wall define a metal receiving chamber having an opening through the annular wall. An upward extending collar wall extends along the periphery of the impact pad above the throat opening. The collar wall has a contoured inner surface merging with an upper surface on the annular wall.

15 Claims, 9 Drawing Sheets

(4 of 9 Drawing Sheet(s) Filed in Color)

IMPACT PAD

FIELD OF THE INVENTION

The present invention relates to a tundish impact pad, and more particularly to a tundish impact pad that reduces flashing and rebound due to a misaligned, incoming metal stream.

BACKGROUND OF THE INVENTION

Liquid metal, in particular liquid steel, is often poured from one vessel to another. For example, liquid metal may be poured from a furnace into a ladle, and then from a ladle into a tundish and from a tundish into a mold. When liquid is poured into the tundish from a ladle, it is normally poured into the tundish through an outlet in the bottom of the ladle. The stream of metal from the ladle is metered by a valve and the outlet stream may be enclosed in a ceramic tube, called a ladle shroud, which extends downward from the ladle bottom.

A typical tundish is a trough or box-shaped vessel having a generally horizontal or flat bottom with vertically arranged walls. The stream of metal poured from the ladle, i.e., incoming ladle stream or flow, enters the tundish and impacts the tundish bottom and spreads in all directions. It is known to use tundish impact pads to try and control an incoming ladle stream to reduce erosion of the tundish lining and to effect certain desirable flow patterns in the tundish. In this respect, prior patents purport to control the flow of the molten metal to prevent non-separation of slag and inclusion particles, to prevent disturbance of smooth, metal flow, and further to prevent thermal inhomogeneity, i.e., short circuit flow and different liquid metal residence times.

Attaining the desired flow patterns requires that the incoming stream from the ladle contacts the bottom of the tundish at a specific location, which is to say it encounters the impact pad at a specific location, generally the geometric center of the pad. However, exact control of an incoming ladle stream is difficult, and it is not unusual for an incoming stream to be slightly off center from its desired location. With cup-shaped impact pads, a misaligned ladle stream can cause the liquid metal to impact the upper surface of the impact pad thereby causing the incoming stream to splash in all directions. Such a misaligned stream would quickly erode the top and side wall of the impact pad, thereby defeating the purpose of the impact pad and possibly exacerbating the problems the pad was intended to overcome.

The present invention overcomes these and other problems and provides an impact pad having an upper collar adapted to redirect misaligned streams toward the center of the impact pad to reduce the likelihood of lateral splashing and rebounding.

SUMMARY OF THE INVENTION

In accordance with the present invention, there is provided an impact pad for receiving a stream of liquid metal having a bottom wall with an upper surface against which said liquid metal is intended to impact, a side wall extending in an upward direction along the periphery of the bottom wall, and an annular wall extending inwardly from the side wall. The annular wall, together with the bottom wall and side wall, define a metal receiving chamber having an opening through the annular wall. An upward extending collar wall extends along the periphery of the impact pad above the throat opening. The collar wall has a contoured inner surface merging with an upper surface on the annular wall for directing a stream of liquid metal offset from the opening back toward the opening.

It is an object of the present invention to provide an impact pad for receiving a stream of molten metal.

It is another object of the present invention to provide an impact pad as described above that dampens and contains a stream of molten metal.

It is another object of the present invention to provide an impact pad that accommodates a slightly misaligned incoming metal stream.

It is another object of the present invention to provide an impact pad as described above which reduces the likelihood of lateral splashing of a slightly misaligned incoming metal stream.

These and other objects will become apparent from the following description of a preferred embodiment taken together with the accompanying drawings and the appended claims.

BRIEF DESCRIPTION OF THE DRAWINGS

The claim of this patent contains at least one drawing executed in color.

The invention may take physical form in certain parts and arrangement of parts, a preferred embodiment of which will be described in detail in the specification and illustrated in the accompanying drawings which form a part hereof, and wherein.

DETAILED DESCRIPTION OF PREFERRED EMBODIMENT

Figure 1:
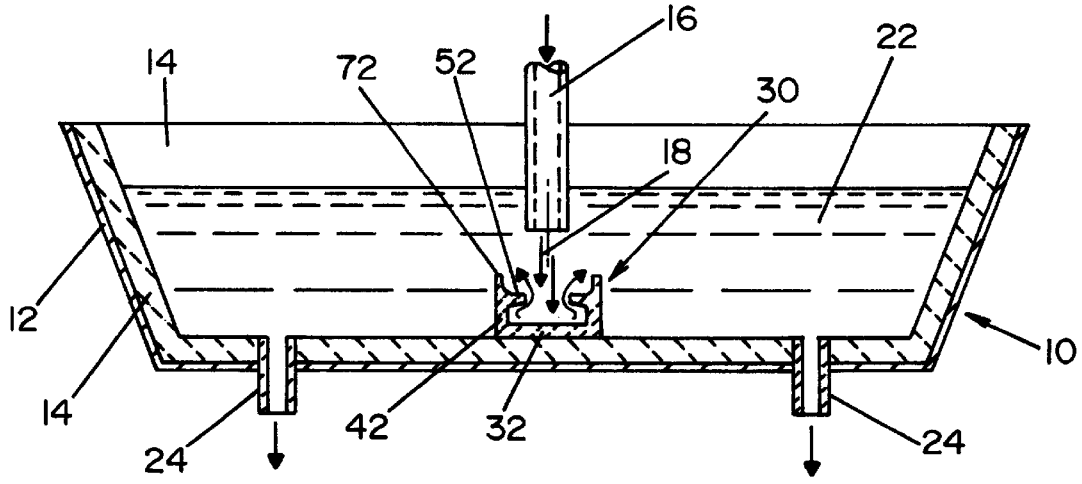
FIG. 1 is a cross-sectional view of a tundish, showing an impact pad according to the present invention on the bottom thereof.

Referring now to the drawings wherein the showings are for the purpose of illustrating preferred embodiments of the invention only, and not for the purpose of limiting same, FIG. 1 shows a conventional tundish 10 for use in a steel making process. Tundish 10 has an outer metallic shell 12 and an inner refractory lining 14. A ladle shroud 16 is positioned above tundish 10 to direct a stream 18 of molten metal from a ladle (not shown) into tundish 10 to form a molten metal bath 22. Tundish 10 includes a pair of well blocks 24 to allow molten metal from bath 22 to enter molds (not shown), as is conventionally known.

Figure 2:
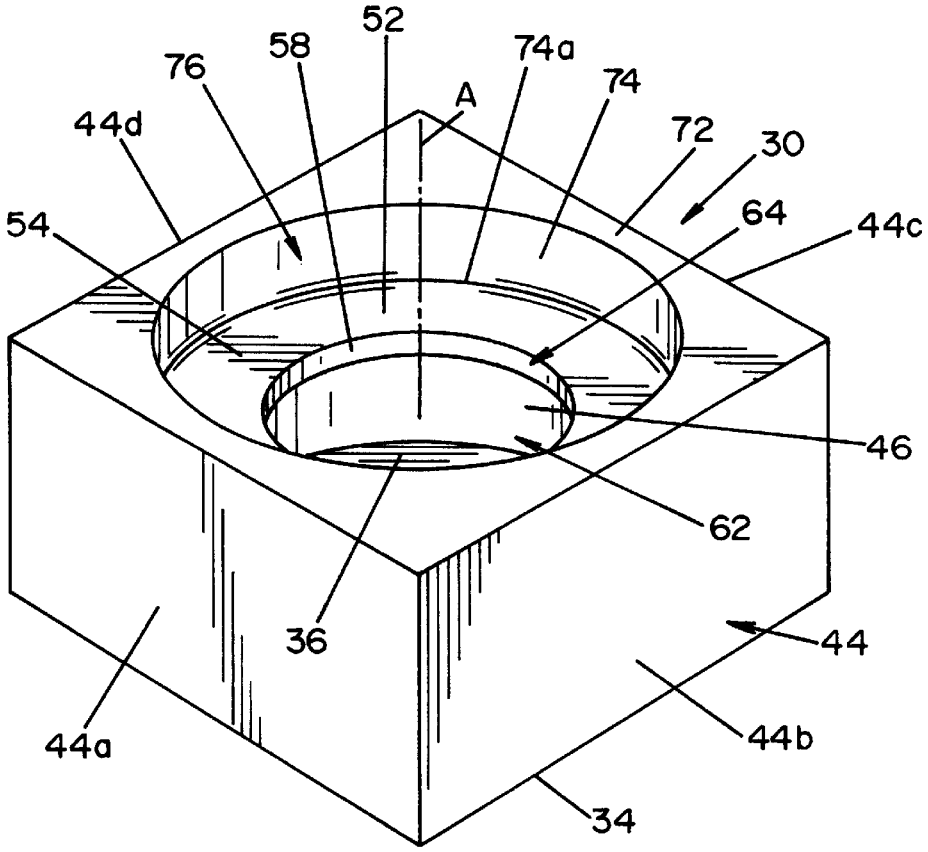
FIG. 2 is a perspective view of the impact pad shown in FIG. 1, illustrating a preferred embodiment of the present invention.
Figure 3:
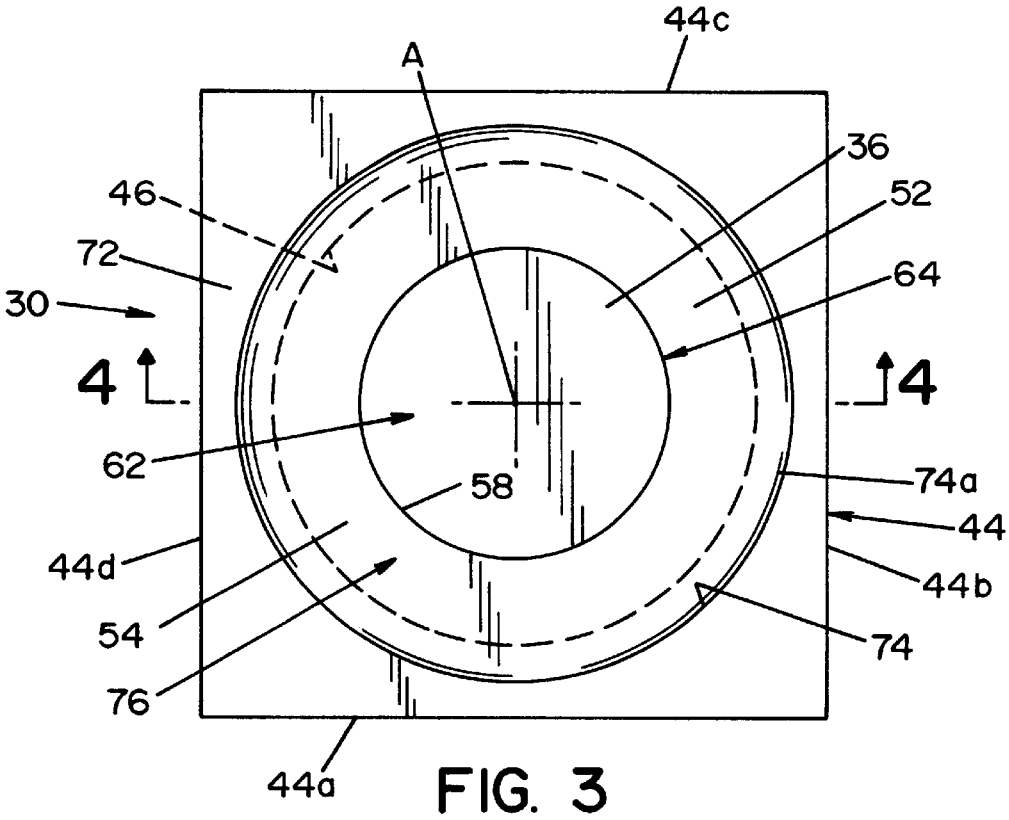
FIG. 3 is a top, plan view of the impact pad shown in FIG. 2.
Figure 4:
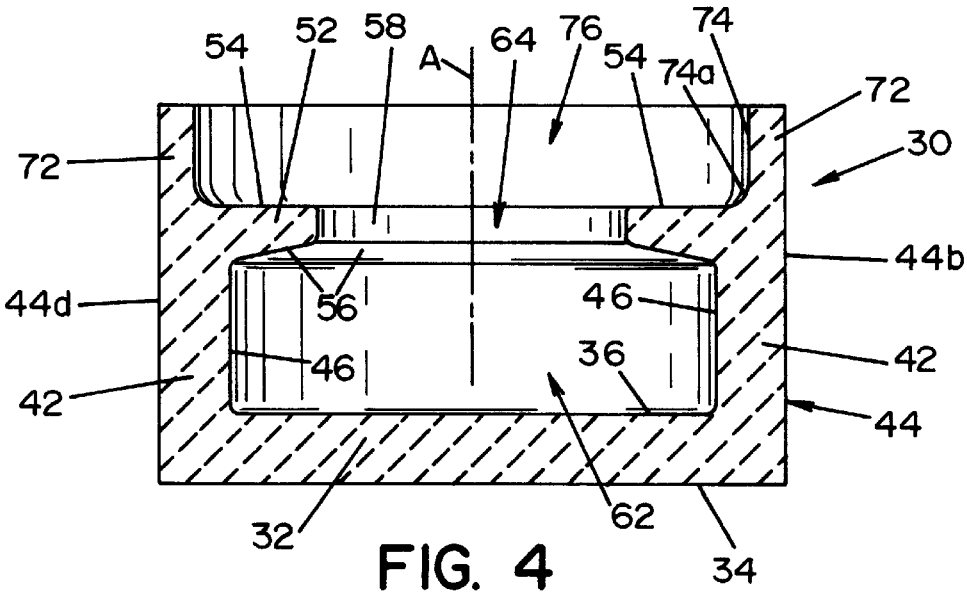
FIG. 4 is a sectional view taken along lines 4—4 of FIG. 3.

An impact pad 30, illustrating a preferred embodiment of the present invention, is positioned within tundish 10 below shroud 16 to receive stream 18. As best seen in FIGS. 2–4, impact pad 30 is generally rectangular in shape and has a bottom wall 32 having a lower surface 34 (best seen in FIG. 4) and an upper, impact surface 36 adapted to receive stream 18 of molten metal. In the embodiment shown, bottom wall 32 has a flat, generally planar, upper, impact surface 36. A side wall 42 projects upwardly from the periphery of bottom wall 32. Side wall 42 has an outer surface 44, that is defined by four (4) planar surfaces, designated 44*a*, 44*b*, 44*c* and 44*d*. Surfaces 44*a*, 44*b*, 44*c* and 44*d* define the rectangular, outer profile of impact pad 30. Side wall 42 has a generally cylindrical, inner surface 46 that is symmetrical about an axis "A" that extends generally perpendicular to upper, impact surface 36. An annular, inwardly projecting wall 52 extends from side wall 42. In the embodiment shown, annular wall 52 has a generally planar, upper surface 54 and an inwardly and upwardly sloping bottom surface 56. Annular wall 52 has an annular, inner edge surface 58.

Bottom wall 32, side wall 42 and annular wall 52 together define an interior cavity or chamber 62 having an upper opening 64 through annular wall 52 defined by inner edge surface 58 of annular wall 52.

Side wall 42 extends upward, above annular wall 52, to define a collar or rim 72 that projects above opening 64 and upper surface 54 of annular wall 52. The outer surface of collar 72 is basically defined by surfaces 44*a*, 44*b*, 44*c* and 44*d* of side wall 44. Collar 72 has an inner surface 74 that is generally cylindrical in shape and that also is symmetrical about axis "A." In the embodiment shown, inner surface 74 has a diameter slightly larger than the diameter of inner surface 46 of side wall 42. The lower end 74*a* of surface 74 is rounded inwardly to effect a smooth, contoured transition between inner surface 74 and upper surface 54 of annular wall 52. Collar 72 defines a cavity 76 that is in communication with chamber 62 through opening 64. Impact pad 30 is formed by conventional molding techniques, known to those skilled in the art. Impact pad 30 may be formed of many different types of refractory materials, but in a preferred embodiment, is formed of a high alumina refractory manufactured and sold by North American Refractories Co., Pittsburgh, Pa., under the trade designation NARCON 70.

Referring now to the operation of impact pad 30, as indicated above, impact pad 30 is disposed below stream 18 to receive the same. Impact pad 30 is dimensioned such that opening 64 is larger than the diameter of stream 18. As stream 18 impacts upper surface 36 of bottom wall 32, molten metal is directed in all directions along upper surface 36 to inner surface 46 of side wall 42. Upon engaging surface 46, the molten metal is turned and is directed toward the upwardly and inwardly sloping bottom surface 56 of annular wall 52, which forces the molten metal out opening 64 past incoming stream 18. In other words, the rebounding metal is redirected back toward incoming stream 18 to cushion and reduce the velocity of the same. As will be appreciated, the molten metal flowing against the incoming stream 18 has a tendency to be pushed outwardly once it exits chamber 62 through opening 64. In this respect, contoured surface 74*a* and inner surface 74 of collar 72 direct this outward flowing molten metal back into a vertical direction further retarding the incoming stream.

Figure 5A:
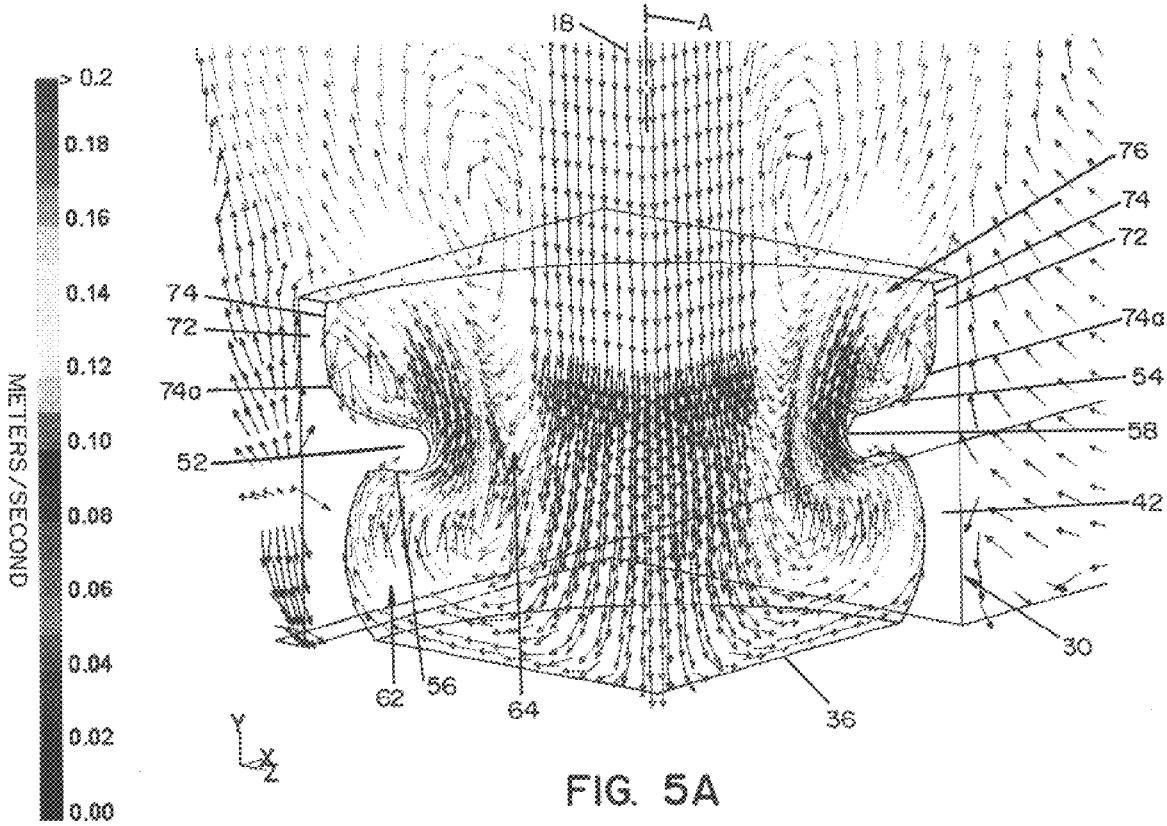
FIGS. 5A, 5B, 5C and 5D are computer-generated metal flow profiles for an impact pad according to the present invention.
Figure 5B:
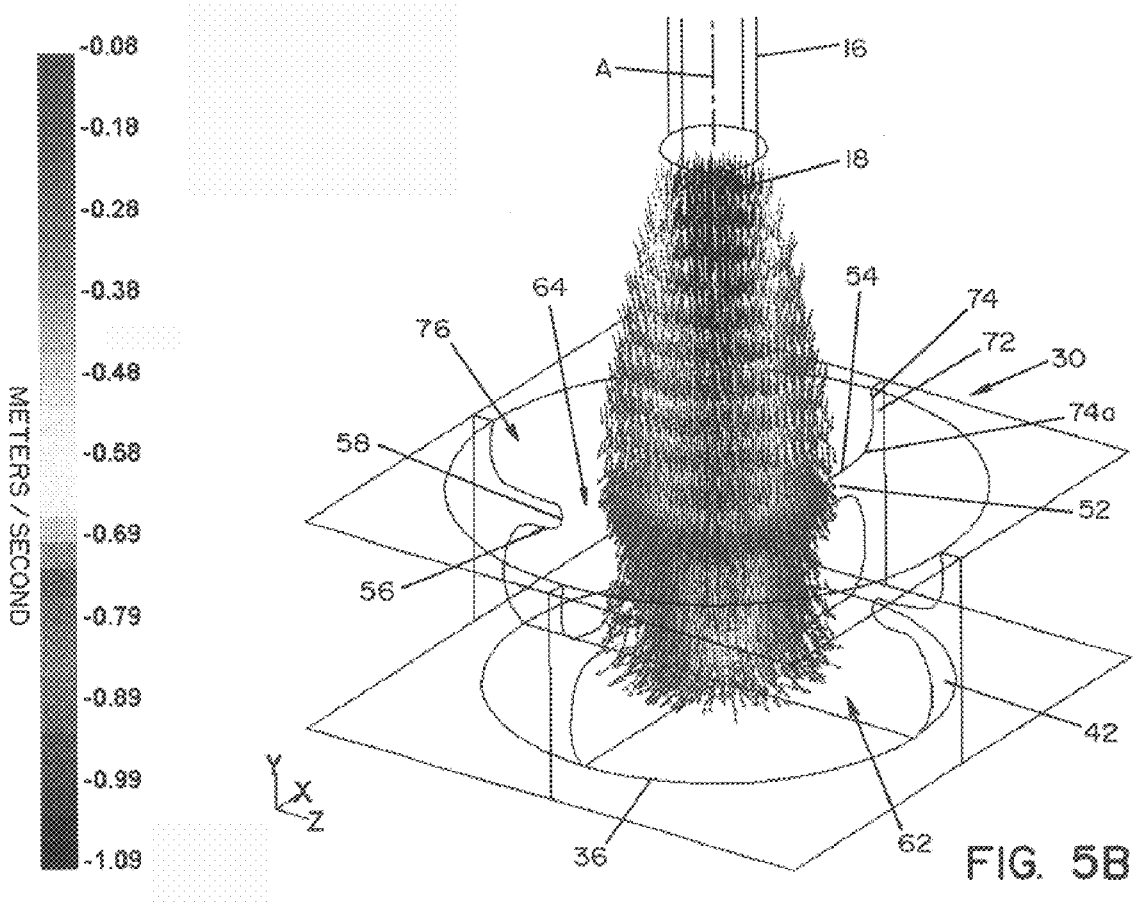

FIGS. 5A–5D are colored, computer-generated flow models that illustrate the velocity field and flow path of metal from stream 18 in and around an impact pad 30 in accordance with the present invention. FIG. 5A is a sectional view showing the velocity, i.e., direction and magnitude, of flow of metal from stream 18. The color shading of the image provides an indication of the velocity of the metal at different locations within and around impact pad 30. In FIGS. 5A–5D, flow in an upward direction relative to impact pad 30 is indicated by positive values, while downward flow of the metal is indicated by negative values. Stated another way, in FIGS. 5A, 5C and 5D (that each show metal flowing upward), a higher metal speed is indicated by shades of red and a lower metal speed is indicated by blue. On the other hand, in FIG. 5B (that shows metal stream 18 moving downward) the velocity is indicated as being negative, and a lower speed is indicated by shades of red and a faster speed is indicated by shades of blue. Referring now to FIG. 5B, an incoming stream of molten metal is illustrated as it enters impact pad 30 in the central portion of impact pad 30. As noted above, the negative symbols on the chart indicate that the metal stream is moving downward and the color code indicates the highest speed of the stream where it exits ladle shroud 16. Incoming stream 18, upon impacting upper surface 36 of bottom wall 32, is directed along the inner surface of side wall 42, and is then forced back up through opening 64.

Figure 5C:
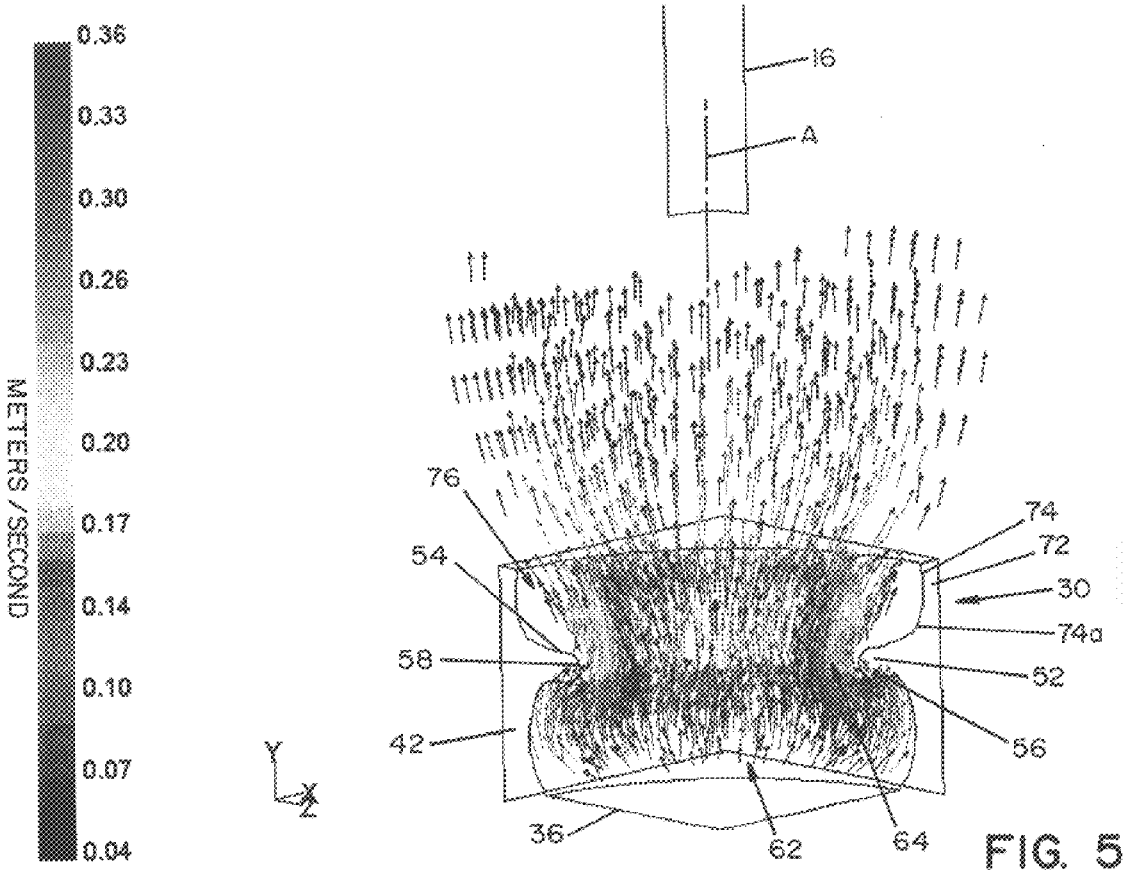

FIG. 5C illustrates how collar 72 guides and redirects the metal exiting from opening 64 in a vertical direction to further retard and reduce the flow of the incoming stream 18. In FIG. 5C, the downward incoming stream 18 that is illustrated in FIG. 5B is not shown. FIG. 5C thus shows the metal flowing out of impact pad 30, and illustrates how collar 72 helps direct the out-flowing metal in a generally vertical direction.

Figure 5D:
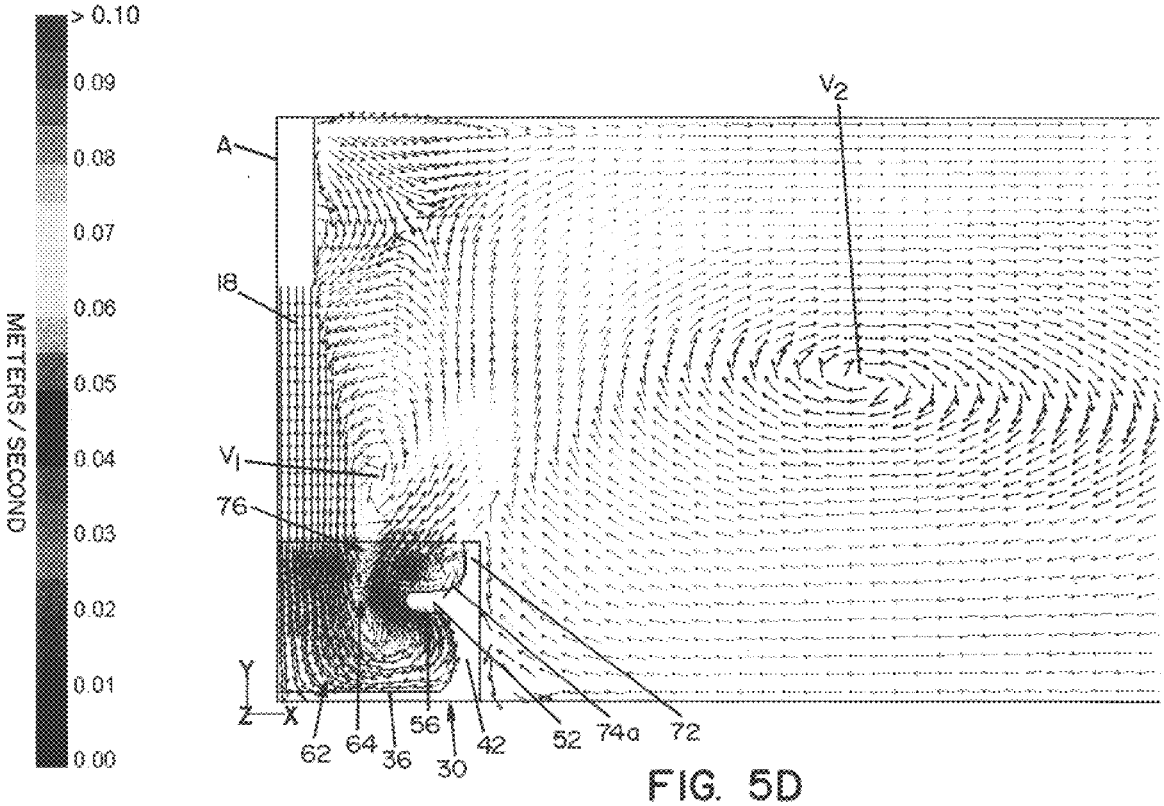

FIG. 5D shows half of impact pad 30 and shows the metal flow profiles in tundish 10 to one side of impact pad 30. Above impact pad 30, a small vortex, $V_1$, is formed by incoming metal stream 18 and the circulating molten metal within tundish 10. The metal forced out of impact pad 30 also creates a larger vortex, $V_2$, to the side of impact pad 30.

Figure 6:
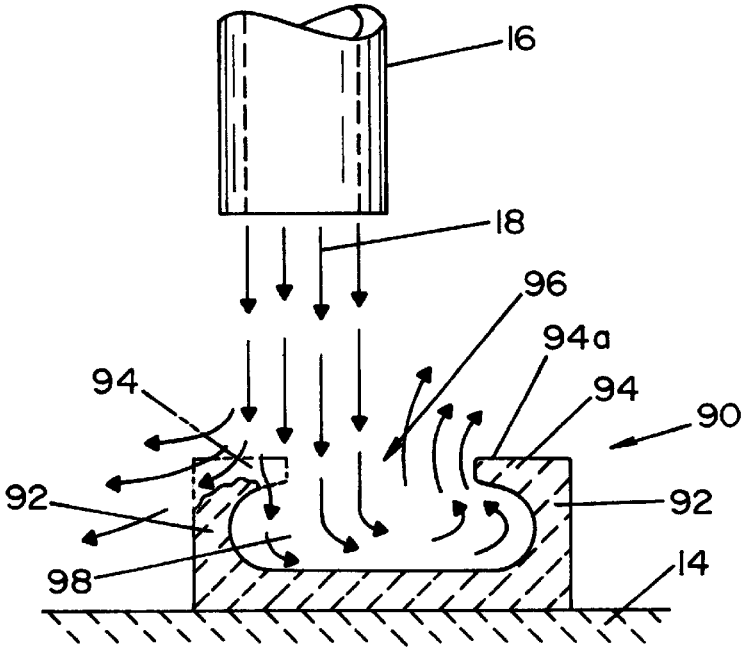
FIG. 6 (PRIOR ART)
FIG. 6 is a pictorial representation of the effect of a misaligned metal stream on a conventional impact pad.
Figure 7:
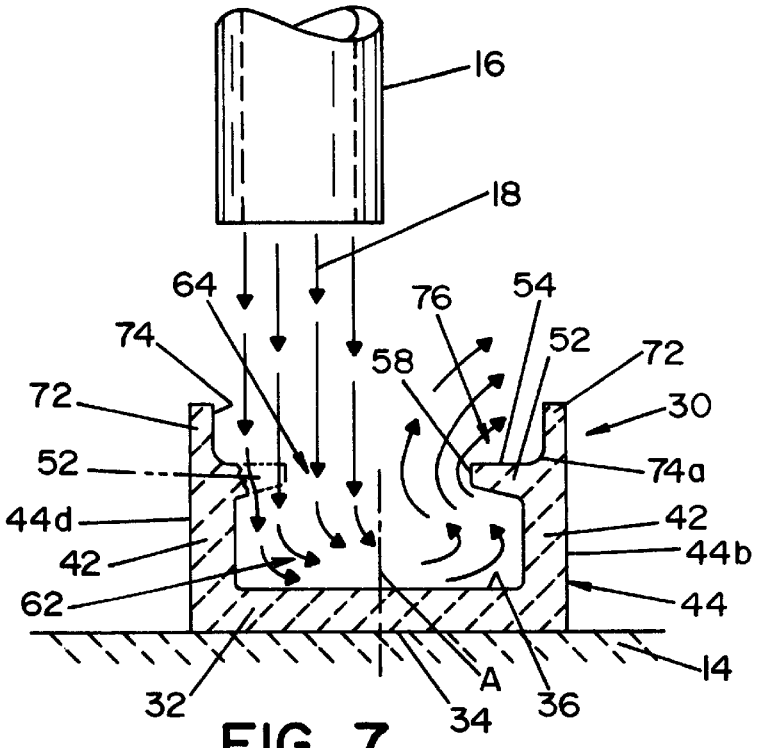
FIG. 7 is a pictorial representation of the effect of a misaligned metal stream on the impact pad shown in FIG. 2.

Referring now to FIGS. 6 and 7, another advantage of impact pad 30 is pictorially illustrated. It is not uncommon for metal stream 18 to be slightly offset from its desired location relative to an impact pad. In this respect, a slight miss-positioning of the impact pad in the tundish or a slight misalignment of shroud 16 can cause stream 18 of molten metal to be misaligned relative to an impact pad. FIG. 6 shows a conventional impact pad 90 initially receiving a misaligned stream 18 of molten metal. Impact pad 90 has a side wall 92 and an upper lip defining an opening 96 communicating with an inner chamber 98. Ideally, stream 18 of an incoming metal flow would be aligned with opening 96 to allow the molten metal to stream into inner chamber 98. FIG. 6 shows stream 18 offset to one side relative to opening 96. When such a condition occurs, the molten metal of stream 18 impacts upon upper surface 94*a* of lip 94 thereby splashing the molten metal to the left and right of wall 92. Some of the molten metal will be directed into inner chamber 98, as desired. However, some of the molten metal will be directed outside impact pad 90. As will be appreciated by those skilled in the art, the initial flow of molten metal will quickly erode lip 94 and the upper end of wall 92. Such erosion effectively destroys the desired control intended by the impact pad, and allows molten metal to stream to one side of impact pad 90 and possibly splash back upward toward the sides of the tundish during the initial filling of the tundish.

FIG. 7 is a pictorial illustration of impact pad 30 with a misaligned stream 18. As schematically illustrated, the misaligned stream will quickly erode annular wall 52 below stream 18, but collar 72 prevents lateral splashing and flow of the molten metal over side wall 42. In other words, collar 72 directs the misaligned flow back toward chamber 62 to enable impact pad 30 to control and retard the flow of stream 18, albeit less than optimally in view of the misaligned stream 18.

The present invention thus provides an impact pad having an annular collar that, in addition to facilitating a desirable flow pattern for an aligned metal stream, also aids in directing a misaligned stream back into the center of the cup to prevent lateral splashing and erosion of the impact pad.

Figure 8:
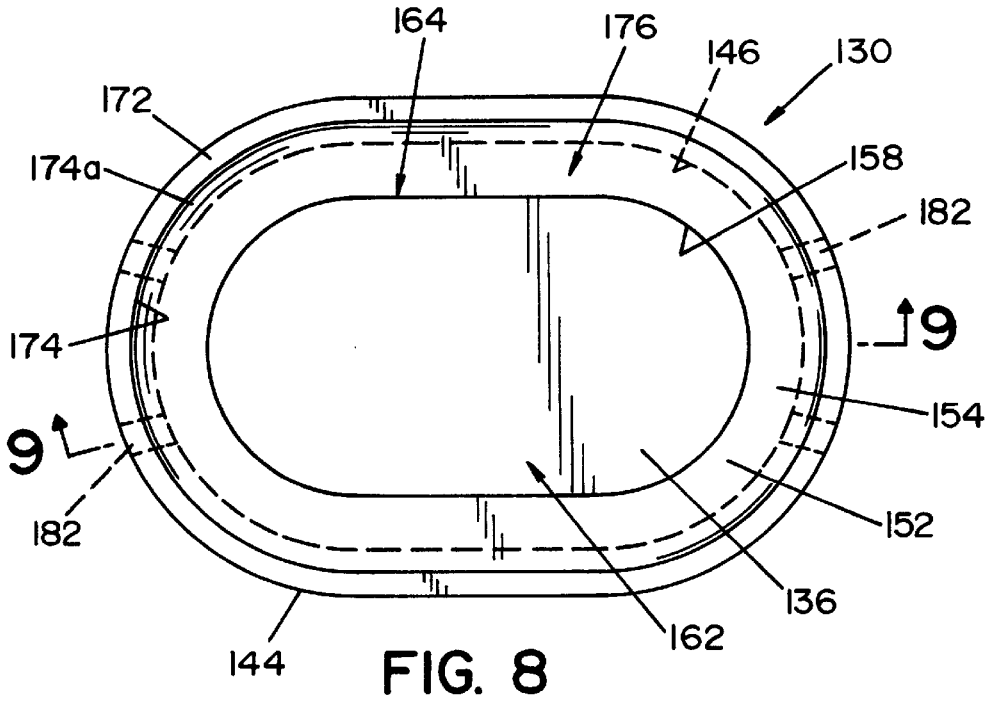
FIG. 8 is a top, plan view of an impact pad, illustrating another embodiment of the present invention.
Figure 9:
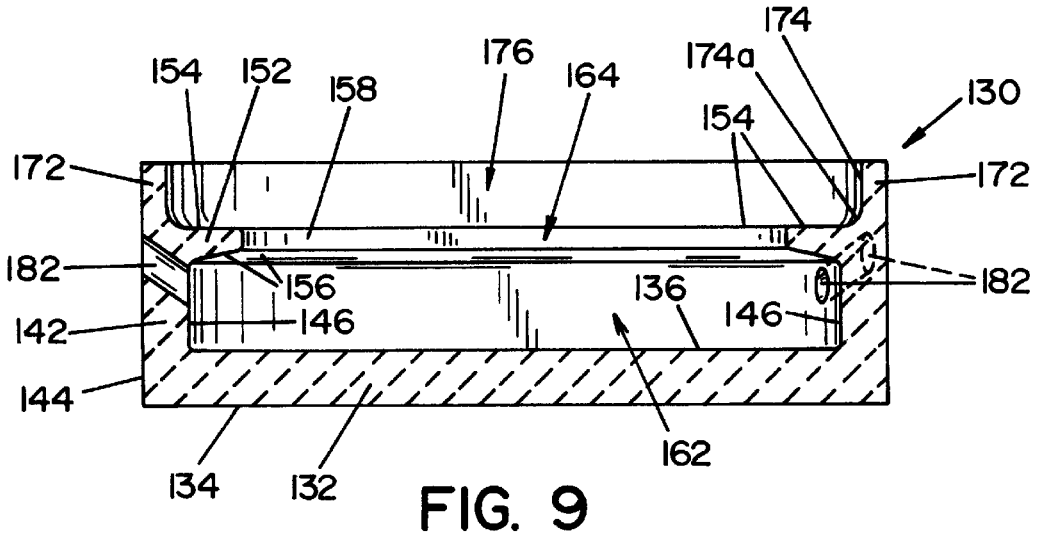
FIG. 9 is a sectional view taken along lines 9—9 of FIG. 8.

Referring now to FIGS. 8 and 9, an impact pad 130 illustrating an alternate embodiment of the present invention is shown. In the embodiment shown, impact pad 130 is obround, although other similar prolate shapes, such as, by way of example and not limitation, an elliptical shape or oval shape may also be used. Impact pad 130 has a bottom wall 132 having a lower surface 134 and an upper, impact surface 136 adapted to receive stream 18. In the embodiment shown, upper impact surface 136 is generally a flat, planar surface. A side wall 142 projects upwardly from the periphery of bottom wall 132. Side wall 142 has a continuous, outer surface 144. An inwardly projecting wall 152 extends from side wall 142. Annular wall 152 has a planar, upper surface 154, and an inwardly and upwardly sloping bottom surface 156. Annular wall 152 defines an annular, inner edge 158. Together, bottom wall 132, side wall 142 and annular wall 152 define an interior cavity or chamber 162 having an upper opening 164 defined by inner edge 158 of annular wall 152.

Side wall 142 extends upward, above annular wall 152 to define a collar or rim 172 that projects above opening 164 and surface 154 of annular wall 152. The outer surface of collar 172 is basically defined by outer surface 144 of side wall 142. Collar 172 defines a cavity 176 and is formed to have an inner surface 174 that is generally parallel to the outer surface 144 of side wall 142 and a rounded, lower end 174*a* that effects a smooth, contoured transition between inner surface 174 of collar 172 and upper surface 154 of annular wall 152.

At the distal ends of the impact pad 130, apertures 182 are formed in side wall 142, as best seen in FIG. 9. In the embodiment shown, two apertures extend through side wall 142 at each end of impact pad 130. Apertures 182 are oriented at 30° relative to the flat bottom surface 134.

Impact pad 130 is dimensioned to be positioned lengthwise in an elongated tundish, wherein the obround shape of opening 164 accommodates a stream 18 of molten metal misaligned along the axis of the tundish. Apertures 182 effectively form a dam or weir that may be used in place of conventionally known refractory dams, thus providing an integral device that provides flow control from an incoming stream of metal, as well as damming and damping effects typically found with weirs and dams conventionally used within tundishes.

As will be appreciated by those skilled in the art, apertures similar to apertures 182 in impact pad 130 may also be provided in impact pad 30 to provide a slight dampening effect to the molten metal from stream 18.

Figure 10:
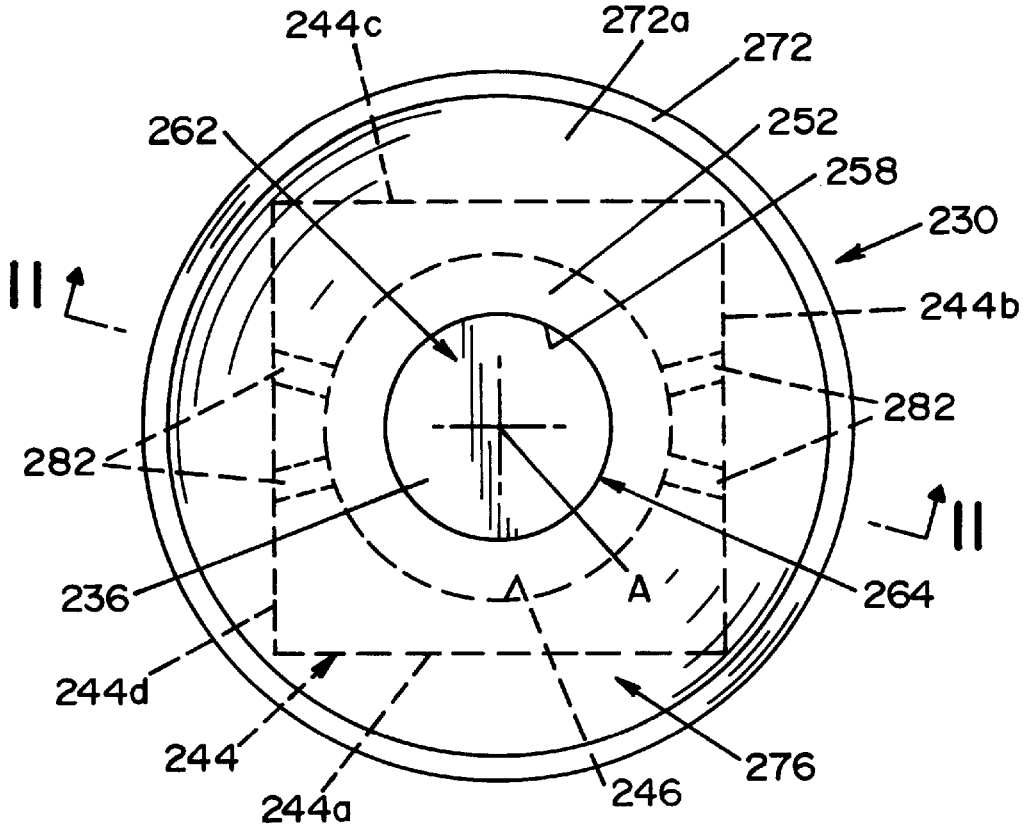
FIG. 10 is a top, plan view of an impact pad, illustrating yet another embodiment of the present invention.
Figure 11:
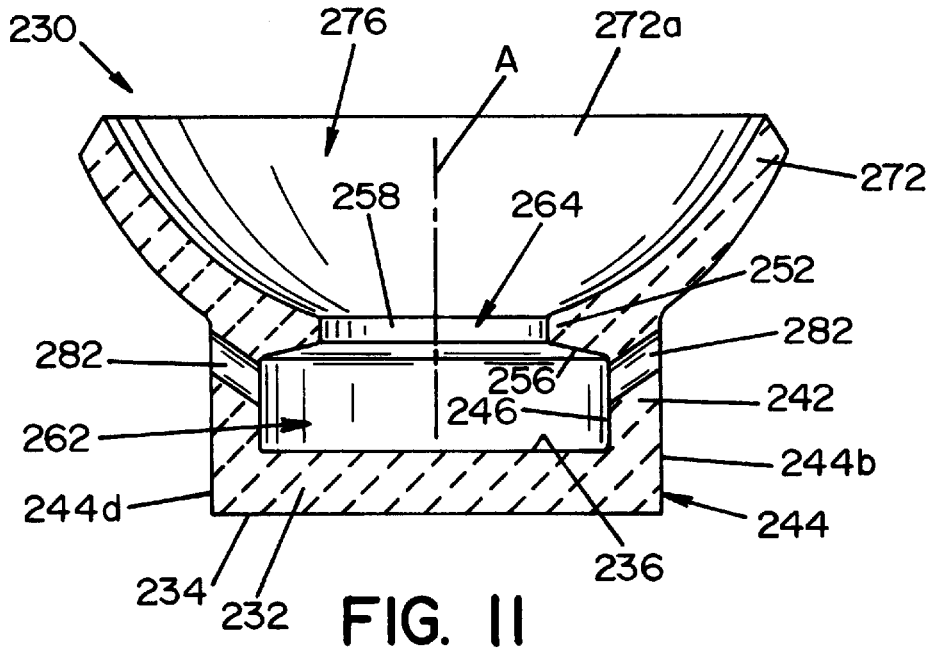
FIG. 11 is a sectional view taken along lines 11—11 of FIG. 10.

Referring now to FIGS. 10 and 11, an impact pad 230 illustrating another embodiment of the present invention is shown. Impact pad 230 has a generally rectangular, i.e., square, base, comprised of a bottom wall 232 having a lower surface 234 and an upper impact surface 236. A side wall 242 projects upwardly from the periphery of bottom wall 232. Side wall 242 has an outer surface 244, that is defined by four (4), planar surfaces 244*a*, 244*b*, 244*c* and 244*d*, best seen in FIG. 10. Side wall 242 has a generally cylindrical, inner surface 246 that is symmetrical about an axis "A" that extends generally perpendicular to upper, impact surface 236. An annular, inwardly projecting wall 252 is formed at the upper end of side wall 242. Annular wall 252 has an inwardly and upwardly sloping bottom surface 256, and an inner edge 258 that defines an opening 264. Together, bottom wall 232, side wall 242 and annular wall 252 define an interior cavity 262. An outwardly flaring collar or rim 272 is formed above annular wall 252. In the embodiment shown, collar 272 defines a cavity 276 and has an inner surface 272*a* that essentially defines the upper surface of annular wall 252. Apertures 282 extend through side wall 242.

Impact pad 230 illustrates an embodiment having an outward flaring, funnel shaped collar 272 having a funnel shaped inner surface 272*a* that is operable to direct misaligned stream 18 toward inner chamber 262. Contoured, inner surface 272*a* of collar 272 assists in redirecting a misaligned stream 18 to avoid splashing and deflection of molten metal outside of impact pad 230.

The foregoing description is a specific embodiment of the present invention. It should be appreciated that this embodiment is described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

Having described the invention, the following is claimed:

1. In an impact pad for receiving a stream of liquid metal, said impact pad having a bottom wall with an upper surface against which said liquid metal is intended to impact, a side wall extending in an upward direction along the periphery of said bottom wall, and an annular wall extending inwardly from said side wall, said annular wall with said bottom wall and side wall defining a metal receiving chamber having an opening through said annular wall, the improvement comprising:

an upward extending collar wall extending along the periphery of said impact pad above said opening, said collar wall having a contoured inner surface merging with an upper surface of said annular wall.

2. An impact pad as defined in claim 1, wherein said impact pad has an outer surface that is generally rectangular in shape.

3. An impact pad as defined in claim 2, wherein said upper surface of said bottom wall is flat.

4. An impact pad as defined in claim 3, wherein said metal receiving chamber is cylindrical in shape.

5. An impact pad as defined in claim 4, wherein said collar defines a cavity having a generally cylindrical, inner wall surface, said cavity communicating with said metal receiving chamber through said opening.

6. An impact pad as defined in claim 5, wherein a diameter of said cavity is larger than a diameter of said metal receiving chamber.

7. An impact pad as defined in claim 1, wherein said collar extends outwardly and upwardly from said opening through said annular wall.

8. An impact pad as defined in claim 7, wherein said collar has a funnel-shaped, inner surface.

9. An impact pad as defined in claim 8, wherein said impact pad has a rectangular base portion.

10. An impact pad as defined in claim 9, wherein said metal receiving chamber is essentially cylindrical in shape.

11. An impact pad as defined in claim 1, wherein said impact pad is prolate in shape, and has a generally continuous outer surface.

12. An impact pad as defined in claim 1, wherein said impact pad is obround.

13. An impact pad as defined in claim 12, wherein said metal receiving chamber is obround, and said opening through said annular wall is obround.

14. An impact pad as defined in claim 13, wherein said side wall at distal ends of said pad includes an aperture extending therethrough defining metal drain ports.

15. An impact pad as defined in claim 14, wherein said collar extends generally perpendicular to said bottom wall.

* * * * *